US010144885B2

(12) United States Patent
Singh et al.

(10) Patent No.: US 10,144,885 B2
(45) Date of Patent: Dec. 4, 2018

(54) PROCESSES AND APPARATUSES FOR REMOVING BENZENE FOR GASOLINE BLENDING

(71) Applicant: UOP LLC, Des Plaines, IL (US)

(72) Inventors: Pankaj Kumar Singh, New Delhi (IN); Alexander V. Sabitov, Wilmette, IL (US); David J. Shecterle, Arlington Heights, IL (US); Mohamed S. M. Shakur, Hoffman Estates, IL (US); Rajaraman Panchapakesan, Haryana (IN)

(73) Assignee: UOP LLC, Des Plaines, IL (US)

( * ) Notice: Subject to any disclaimer, the term of this patent is extended or adjusted under 35 U.S.C. 154(b) by 0 days.

(21) Appl. No.: 15/598,157

(22) Filed: May 17, 2017

(65) Prior Publication Data

US 2017/0349845 A1 Dec. 7, 2017

Related U.S. Application Data

(60) Provisional application No. 62/347,029, filed on Jun. 7, 2016.

(51) Int. Cl.
*C10G 69/02* (2006.01)

(52) U.S. Cl.
CPC ..... *C10G 69/02* (2013.01); *C10G 2400/02* (2013.01)

(58) Field of Classification Search
CPC ..... C10G 69/02
See application file for complete search history.

(56) References Cited

U.S. PATENT DOCUMENTS

| | | | | |
|---|---|---|---|---|
| 3,166,490 | A | 1/1965 | Evans | |
| 3,293,315 | A | 12/1966 | Nixon | |
| 3,304,340 | A * | 2/1967 | Noll | C10G 47/00 208/66 |
| 3,328,476 | A * | 6/1967 | Cabbage | C07C 5/02 208/143 |
| 3,435,084 | A * | 3/1969 | Cabbage et al. | C07C 15/14 585/254 |
| 3,527,823 | A | 9/1970 | Jones | |
| 4,140,622 | A | 2/1979 | Herout et al. | |
| 4,209,383 | A | 6/1980 | Herout et al. | |
| 4,849,569 | A | 7/1989 | Smith, Jr. | |
| 5,210,333 | A | 5/1993 | Bellows et al. | |
| 5,294,334 | A | 3/1994 | Kaul et al. | |
| 7,790,943 | B2 | 9/2010 | Lin et al. | |
| 2007/0299294 | A1 | 12/2007 | Lin et al. | |

FOREIGN PATENT DOCUMENTS

RU 2487161 C1 7/2013

OTHER PUBLICATIONS

Campagna, "Studies Target Reformulated Gasoline Processing Options", Fuel Reformulation, Nov./Dec. 1991, p. 54-59.
D'Auria, "Motor fuels: New approaches/The response of UOP Inc.", Association Francaise des Techniciens du Petrole Roundtable (Paris Nov. 30, 1993) Petrole et Techniques (ISSN 0152-5425) N.388 46-51 (May-Jun. 1994), n 388, p. 46-51, May 1994.
Grezechowiak, "Gasoline with reduced benzene content—process changes", Przem. Chem., v 79, n 2, p. 47-50, 2000.
Hydrocarbon Processing, "HPInnovations: Gasoline benzene reduction alkylation catalytic technology", Hydrocarbon Processing, v 89, n 11, Nov. 2010, p. 23-25.
Search Report dated Sep. 7, 2017 for corresponding PCT Appl. No. PCT/US2017/034372.

* cited by examiner

*Primary Examiner* — Randy Boyer

(57) ABSTRACT

This present disclosure relates to processes and apparatuses for transforming feedstock with high levels of benzene into a low-benzene content product that is suitable for gasoline blending. The benzene rich reformate stream is split in a reformate splitter and the benzene in the benzene rich reformate is saturated in a benzene saturation unit and the gases like hydrogen and LPG are recovered.

19 Claims, 2 Drawing Sheets

PROCESSES AND APPARATUSES FOR REMOVING BENZENE FOR GASOLINE BLENDING

CROSS-REFERENCE TO RELATED APPLICATION

This application claims priority from Provisional Application No. 62/347,029 filed Jun. 7, 2016, the contents of which cited application are hereby incorporated by reference in its entirety.

FIELD

The present disclosure relates to a process for removing benzene from a gasoline blending feedstock. More specifically, the present disclosure relates to processes and apparatuses for removing benzene from gasoline blending feedstock using a benzene saturation unit and recovery of gases like hydrogen and liquefied petroleum gas (LPG).

BACKGROUND

Gasoline is a well know fuel, generally composed of a mixture of several hydrocarbons including aromatics, olefins, naphthenes and paraffins having different boiling points at atmospheric pressure. The benzene specification in the gasoline is a key parameter for further use of gasoline. The primary sources of benzene in the gasoline are the gasoline blending feedstocks, which include naphtha from fluid catalytic cracker (FCC) units and catalytic reformate products (reformate). While the FCC naphtha is the largest blending stock for gasoline and constitutes up to 50% of the final product, the FCC naphtha itself typically contains about 1% benzene and is therefore not a primary contributor. The reformate product normally contains more than 5% benzene and given that approximately 75% of the benzene that is present in gasoline is derived from reformate. To comply with the regulation for benzene specification in gasoline, many refineries have implemented various techniques and strategies to reduce the levels of benzene in gasoline, which generally contains about 2% to about 3% benzene.

Traditionally, chemical processes are used to convert benzene to other desirable and less objectionable components for reducing benzene content in gasoline blending reformate. The chemical processes are followed by physical separation that separates at least a portion of benzene. Other approaches include alkylation of benzene to yield heavier aromatics whose presence in gasoline was more acceptable. These techniques generally consisted of alkylating benzene with light olefins. Unfortunately, many of the alkylation processes were accompanied by undesirable side reactions and all of these techniques increased the costs to gasoline production significantly. Alkylation techniques are described, for example, in U.S. Pat. No. 3,293,315 to Nixon, U.S. Pat. No. 3,527,823 to Jones U.S. Pat. Nos. 4,140,622 and 4,209,383 both to Herout et al., and U.S. Pat. No. 4,849,569 to Smith. Another known approach of reducing the levels of benzene in reformate was to convert benzene into cyclohexane. However, the process is not selective only to benzene and therefore yields a number of undesired by-products. U.S. Pat. No. 5,294,334 to Kaul et al. and U.S. Pat. No. 5,210,333 to Bellows et al. each disclose processes which selectively adsorb benzene from a gasoline stream and thereafter hydrogenate the benzene into cyclohexane without the need for added desorbents. A drawback of these approaches is that since the cyclohexane remains in the gasoline stream, there is a significant reduction in the grade of the gasoline because the octane rating of cyclohexane is much lower than that of benzene.

The other conventional techniques include pretreatment of reformer feed for removal of benzene precursors from the reformer feed or changing the catalyst and operating pressure in reformer operation to reduce the levels of benzene in the gasoline blending stock. All of these approaches have advantages and disadvantages, typically requiring high equipment and capital costs. There is a need for an improved process and apparatus to reduce the benzene levels in gasoline at reduced equipment and capital costs that can be used in grassroot and revamp applications. Further, in the traditional processes to remove benzene from gasoline, the hydrogen and LPG gases are lost as low value off-gas. Therefore, there is a need for a new process and apparatus to remove benzene from gasoline that enables recovery of hydrogen and LPG gases at reduced capital costs.

SUMMARY

An embodiment of the subject matter is a process removing benzene from a gasoline blending feedstock, the process comprising the steps of providing the feedstock comprising benzene to a catalytic reforming unit to provide a $C_{5+}$ hydrocarbon stream. The $C_{5+}$ hydrocarbon stream is passed to a reformate splitter to provide an overhead fraction, a side cut fraction and a bottom fraction. The side cut fraction is passed to a benzene saturation reactor in a benzene saturation unit to provide a saturated reformate stream. The saturated reformate stream is passed to a stripper in the benzene saturation unit to provide a benzene lean reformate stream and an off-gas stream. The off-gas stream is recycled to a recontact recovery unit to recover hydrogen gas and liquefied petroleum gas (LPG).

Another embodiment of the subject matter is a process for removing benzene from a gasoline blending feedstock, the process comprising the steps of providing the feedstock comprising benzene to a catalytic reforming unit to provide a $C_{5+}$ hydrocarbon stream. The $C_{5+}$ hydrocarbon stream is passed to a reformate splitter to provide an overhead fraction and a bottom fraction. The overhead fraction is passed to a benzene saturation reactor in a benzene saturation unit to provide a saturated reformate stream. The saturated reformate stream is passed to a stripper in the benzene saturation unit to provide a benzene lean reformate stream and an off-gas stream. The off-gas stream is recycled to a recontact recovery unit to recover hydrogen gas and liquefied petroleum gas.

A further embodiment of the subject matter is an apparatus for removing benzene from a gasoline blending feedstock comprising a catalytic reforming unit to convert heavy naphtha to a high octane liquid reformate. A recontact recovery unit is downstream of the catalytic reforming unit. A stabilizer is downstream of recontact recovery unit. A reformate splitter is downstream of the stabilizer. A benzene saturation unit is downstream of the reformate splitter. The benzene saturation unit further comprises a benzene saturation reactor and a stripper column and the stripper column is downstream of the benzene saturation reactor in the benzene saturation unit. It is an advantage of the subject matter to recover gases like the hydrogen and LPG that are generally lost as off-gas in the process of reducing benzene from gasoline blending feedstocks by providing a novel process and apparatus. The present subject matter seeks to provide an improved process and apparatus to reduce the benzene content to as low as less than about 0.1% in the final product that can be used for gasoline blending.

Additional objects, advantages and novel features of the examples will be set forth in part in the description which follows, and in part will become apparent to those skilled in the art upon examination of the following description or may be learned by production or operation of the examples. The objects and advantages of the concepts may be realized and attained by means of the methodologies, instrumentalities and combinations particularly pointed out in the appended claims.

Figure 1:
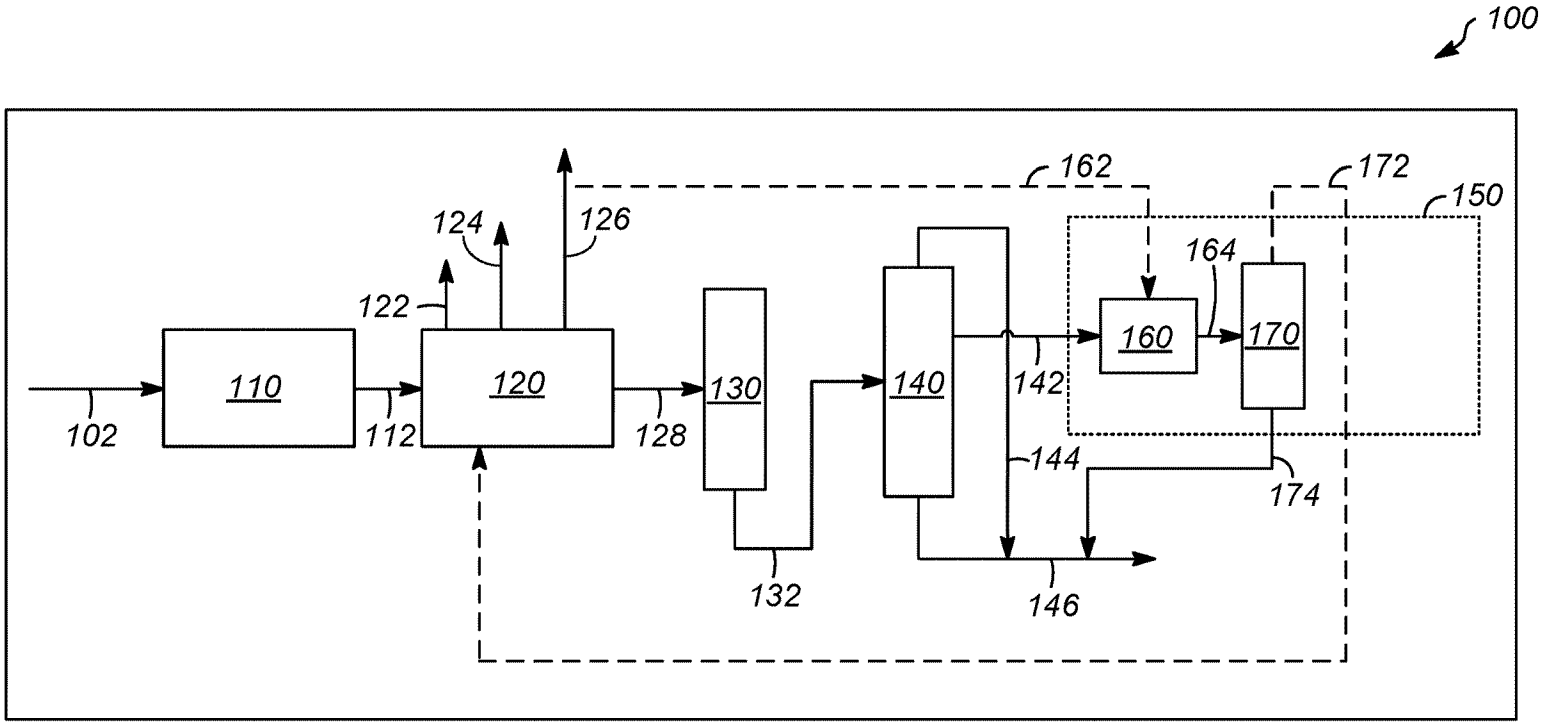
FIG. 1 is a flow scheme for the process and apparatus of the present disclosure.

Corresponding reference characters indicate corresponding components throughout the drawing. Skilled artisans will appreciate that elements in the Figures are illustrated for simplicity and clarity and have not necessarily been drawn to scale. For example, the dimensions of some of the elements in the Figures may be exaggerated relative to other elements to help to improve understanding of various embodiments of the present disclosure. Also, common but well-understood elements that are useful or necessary in a commercially feasible embodiment are often not depicted in order to facilitate a less obstructed view of these various embodiments of the present disclosure.

DETAILED DESCRIPTION

The following description is not to be taken in a limiting sense, but is made merely for the purpose of describing the general principles of exemplary aspects. The scope of the present disclosure should be determined with reference to the claims.

A general understanding of the process can be obtained by reference to FIG. 1. The FIG. 1 has been simplified by the deletion of a large number of apparatuses customarily employed in a process of this nature, such as vessel internals, temperature and pressure controls systems, flow control valves, recycle pumps, etc. which are not specifically required to illustrate the performance of the subject matter. Furthermore, the illustration of the process of this subject matter in the embodiment of a specific drawing is not intended to limit the subject matter to specific embodiments set out herein.

The present subject matter, as shown in FIG. 1, includes an apparatus 100 for a process for removing benzene from a gasoline blending feedstock. Many configurations of the present invention are possible, but specific embodiments are presented herein by way of example. A feed comprising benzene in line 102 is passed to the apparatus 100. The apparatus 100 comprises a catalytic reforming unit 110. The feed in line 102 may be heavy naphtha from crude unit, hydrocracker unit, fluid catalytic cracking unit or coker unit. The feed may comprise benzene concentration in the range from about 1 wt % to about 30 wt %. The feed is passed to the catalytic reforming unit 110 to provide an effluent stream comprising $C_{5+}$ hydrocarbons in line 112. The effluent from the catalytic reforming unit 110 in line 112 is passed to a recontact recovery unit 120. The recontact recovery unit 120 is in downstream communication with the catalytic reforming unit 110. An effluent taken in line 128 from the recontact recovery unit 120 is passed to a stabilizer 130. The effluent from the recontact recovery unit 120 in line 128 comprises $C_{5+}$ hydrocarbons. The stabilizer is in downstream communication with the recontact recovery unit 120 and the catalytic reforming unit 110.

An effluent comprising $C_{5+}$ hydrocarbons is taken at the bottom of the stabilizer 130 in line 132. The $C_{5+}$ hydrocarbons in line 132 is passed to a reformate splitter 140. The reformate splitter 140 is in downstream communication with the stabilizer 130. The reformate splutter 140 is in downstream communication with the catalytic reforming unit 110 and the recontact recovery unit 120. The effluent stream in line 132 is split in the reformate splitter 140 into an overhead fraction stream in line 144, a side cut fraction stream in line 142 and a bottom fraction stream in line 146. The overhead fraction stream in line 144 and the bottom fraction stream in line 146 may be removed as light reformate stream from the apparatus 100. The light reformate stream is free of benzene and $C_6$ hydrocarbons. The side cut fraction stream in line 142 is a benzene rich reformate stream. The benzene rich reformate stream in line 142 is passed to benzene saturation unit 150. A portion of the overhead stream from the reformate splitter 140 in line 144 may be passed along with the side cut stream in line 142 to the benzene saturation unit 150. The benzene saturation unit 150 is in downstream communication with the reformate splitter 140. The benzene saturation unit 150 is in downstream communication with the stabilizer 130, catalytic reforming unit 110 and the recontact recovery unit 120. The benzene saturation unit 150 comprises a benzene saturation reactor 160 and a stripper column 170. The stripper column 170 is in downstream communication with the benzene saturation reactor 160.

The benzene rich reformate stream in line 142 is passed to the benzene saturation reactor 160. A hydrogen gas stream may be passed to the benzene saturation unit 160 to saturate the benzene rich reformate stream in line 142. The benzene rich reformate stream is saturated in the benzene saturation reactor 160. The aromatics and olefins present in the side cut fraction stream 142 are saturated in the benzene saturation reactor 160. The operating conditions of the benzene saturation reactor will include an operating inlet temperature in a range from about 120° C. to about 200° C. A saturated reformate stream is taken as effluent from the benzene saturation reactor 160 in line 164. The operating conditions of the benzene saturation reactor will include an operating outlet temperature in a range from about 150° C. to about 290° C. The operating conditions of the benzene saturation reactor 160 will include an operating pressure in a range from about 1370 kPa to about 3450 kPa. The LHSV of the benzene saturation unit may be in the range from about 5 $hr^{-1}$ to about 25 $hr^{-1}$. The saturated reformate stream in line 164 is passed to the stripper column 170 of the benzene saturation unit 150. A benzene lean reformate stream is taken at the bottom of the stripper column in line 174. The operating conditions of the stripper column will include an operating temperature in a range from about 70° C. to about 150° C. The operating conditions of the stripper column will include an operating overhead pressure in a range from about 780 kPa to about 1670 kPa. The benzene lean reformate stream in line 174 may be further used for gasoline blending. An off-gas stream is taken at the overhead of the stripper column in line 172. The off-gas stream from the stripper column in line 172 may be recycled to the recontact recovery unit 120. An off-gas stream in line 122, a hydrogen gas stream in line 126 and a LPG stream in line 124 may be taken at the overhead of the recontact recovery unit 120 for further use in other chemical processes. A portion of the hydrogen gas stream in line 126 from the recontact recovery unit 120 taken in line 162 may be passed to the benzene saturation reactor 160 for saturating the benzene rich reformate stream in line 142.

The concentration of benzene in the benzene lean reformate stream taken at the bottom of the stripper column 170 in line 174 may be less than about 0.5%. The concentration of benzene in the benzene lean reformate stream taken at the bottom of the stripper column 170 in line 174 may be preferably less than about 0.1%. The benzene and benzene precursors may be removed in a naphtha splitter column upstream of the catalytic reforming unit 110 (not shown). The benzene precursors may include methylcyclopentane (MCP) and cyclohexane (CH).

Figure 2:
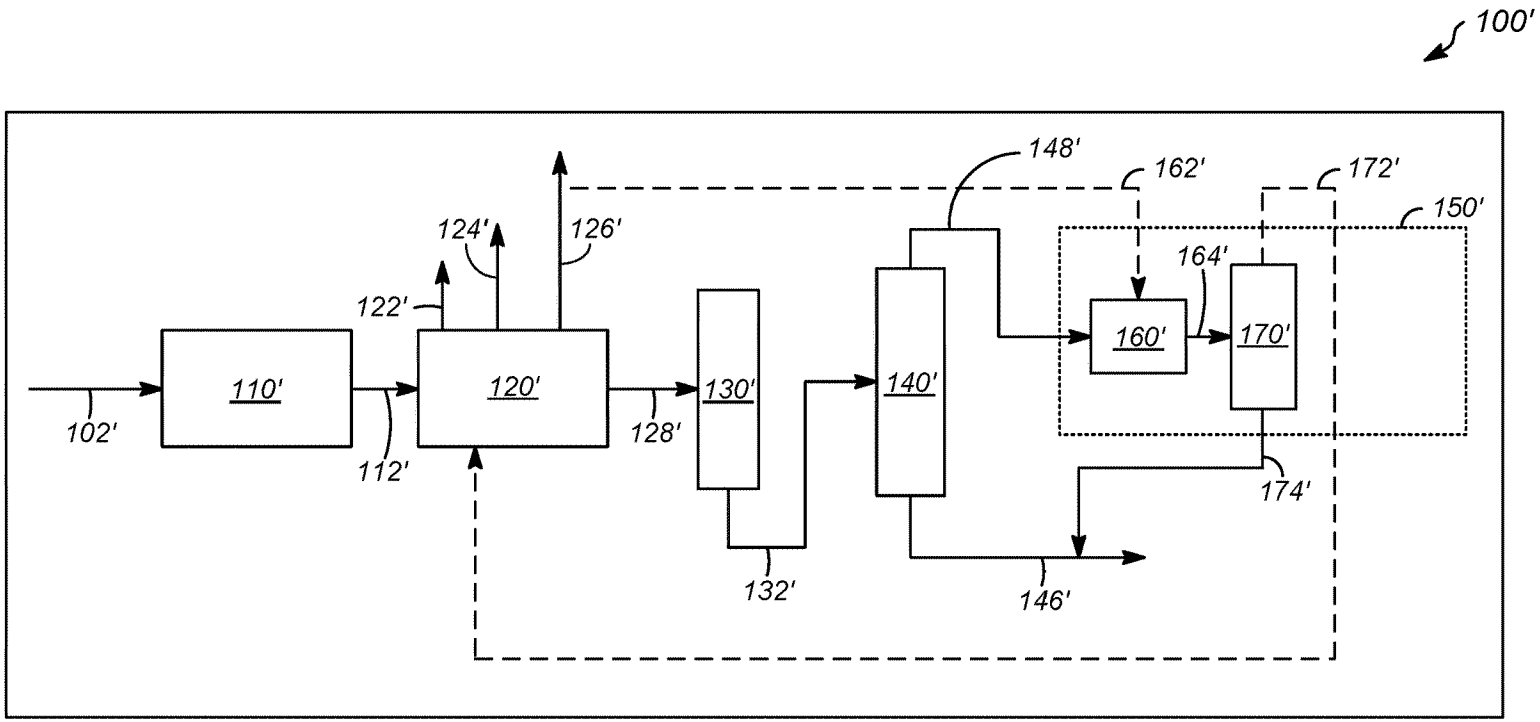
FIG. 2 is an alternative embodiment for the process and apparatus of the present disclosure.

Turning now to FIG. 2, alternative embodiment of the process of the present subject matter shown in FIG. 1 to remove benzene from a gasoline blending feedstock. The embodiment of FIG. 2 differs from the embodiment of FIG. 1 in passing the overhead fraction from the reformate splitter to the benzene saturation unit. The similar components in FIG. 2 that were described above for FIG. 1 will not be described again for FIG. 2. Many of the elements in FIG. 2 have the same configuration as in FIG. 1 and bear the same reference number. Elements in FIG. 2 that correspond to elements in FIG. 1 but have a different configuration bear the same reference numeral as in FIG. 1 but are marked with a prime symbol (').

The present subject matter, as shown in FIG. 2, includes an apparatus 100' to remove benzene from a gasoline blending feedstock. Many configurations of the present invention are possible, but specific embodiments are presented herein by way of example. A feed comprising benzene in line 102' is passed to the apparatus 100'. The apparatus 100' comprises a catalytic reforming unit 110'. The feed in line 102' may be heavy naphtha from crude unit, hydrocracker unit, fluid catalytic cracking unit or coker unit. The feed may comprise benzene concentration in the range from about 1 wt % to about 30 wt %. The feed is passed to the catalytic reforming unit 110' to provide an effluent stream comprising $C_{5+}$ hydrocarbons in line 112'. The effluent from the catalytic reforming unit 110' in line 112' is passed to a recontact recovery unit 120'. The recontact recovery unit 120' is in downstream communication with the catalytic reforming unit 110'. An effluent is taken in line 128' from the recontact recovery unit 120' is passed to a stabilizer 130'. The effluent from the recontact recovery unit 120' in line 128' comprises $C_{5+}$ hydrocarbons. The stabilizer is in downstream communication with the recontact recovery unit 120' and the catalytic reforming unit 110'.

An effluent comprising $C_{5+}$ hydrocarbons is taken in line 132' at the bottom of the stabilizer 130'. The $C_{5+}$ hydrocarbons in line 132' is passed to a reformate splitter 140'. The reformate splitter is in downstream communication with the stabilizer 130'. The reformate splitter 140' is in downstream communication with the catalytic reforming unit 110' and the recontact recovery unit 120'. The effluent stream in line 132' is split in the reformate splitter 140' into an overhead fraction stream in line 148 and a bottom fraction stream in line 146'. The bottom fraction stream in line 146' may be removed as light reformate stream from the apparatus 100'. The light reformate stream is free of benzene and $C_6$ hydrocarbons. The overhead fraction stream in line 148 is a benzene rich reformate stream. The benzene rich reformate stream in line 148 is passed to benzene saturation unit 150'. The benzene saturation unit 150' is in downstream communication with the reformate splitter 140'. The benzene saturation unit 150' is in downstream communication with the stabilizer 130', catalytic reforming unit 110' and the recontact recovery unit 120'. The benzene saturation unit 150' comprises a benzene saturation reactor 160' and a stripper column 170'. The stripper column 170' is in downstream communication with the benzene saturation reactor 160'.

The benzene rich reformate stream in line 148 is passed to the benzene saturation reactor 160'. A hydrogen gas stream may be passed to the benzene saturation unit 160' to saturate the benzene rich reformate stream in line 148. The benzene rich reformate stream is saturated in the benzene saturation reactor 160'. The aromatics and olefins present in the overhead fraction stream in line 148 are saturated in the benzene saturation reactor 160'. The operating conditions of the benzene saturation reactor will include an operating inlet temperature in a range from about 120° C. to about 200° C. A saturated reformate stream is taken as effluent from the benzene saturation reactor 160' in line 164'. The saturated reformate stream in line 164' is passed to the stripper column 170' of the benzene saturation unit 150'. The operating conditions of the benzene saturation reactor will include an operating outlet temperature in a range from about 150° C. to about 290° C. The operating conditions of the benzene saturation reactor 160' will include an operating pressure in a range from about 1370 kPa to about 3450 kPa. The LHSV of the benzene saturation unit may be in the range from about 5 $hr^{-1}$ to about 25 $hr^{-1}$. A benzene lean reformate stream is taken at the bottom of the stripper column in line 174'. The operating conditions of the stripper column will include an operating temperature in a range from about 70° C. to about 150° C. The operating conditions of the stripper column will include an operating overhead pressure in a range from about 780 kPa to about 1670 kPa. The benzene lean reformate stream in line 174' may be further used for gasoline blending. An off-gas stream is taken at the overhead of the stripper column in line 172'. The off-gas stream from the stripper column in line 172' may be recycled to the recontact recovery unit 120'. An off-gas stream in line 122', a hydrogen gas stream in line 126' and a liquefied petroleum gas (LPG) stream in line 124' may be taken at the overhead of the recontact recovery unit 120' for further use in other chemical processes. A portion of the hydrogen gas stream in line 126' from the recontact recovery unit 120' taken in line 162' may be passed to the benzene saturation reactor 160' for saturating the benzene rich reformate stream in line 148.

The concentration of benzene in the benzene lean reformate stream taken at the bottom of the stripper column 170' in line 174' may be less than about 0.5%. The concentration of benzene in the benzene lean reformate stream taken at the bottom of the stripper column 170' in line 174' may be preferably less than about 0.1%. The benzene and benzene precursors may be removed in a naphtha splitter column upstream of the catalytic reforming unit 110' (not shown). The benzene precursors may include methylcyclopentane (MCP) and cyclohexane (CH).

While the subject matter has been described with what are presently considered the preferred embodiments, it is to be understood that the subject matter is not limited to the disclosed embodiments, but it is intended to cover various modifications and equivalent arrangements included within the scope of the appended claims.

Specific Embodiments

While the following is described in conjunction with specific embodiments, it will be understood that this description is intended to illustrate and not limit the scope of the preceding description and the appended claims.

A first embodiment of the subject matter is a process for removing benzene from a gasoline blending feedstock, the process comprising the steps of: providing the feedstock comprising benzene to a catalytic reforming unit to provide a $C_{5+}$ hydrocarbon stream; passing the $C_{5+}$ hydrocarbon stream to a reformate splitter to provide an overhead fraction, a side cut fraction and a bottom fraction; passing the side cut fraction to a benzene saturation reactor in a benzene saturation unit to provide a saturated reformate stream; passing the saturated reformate stream to a stripper in the benzene saturation unit to provide a benzene lean reformate stream and an off-gas stream; and recycling the off-gas stream to a recontact recovery unit to recover hydrogen gas and liquefied petroleum gas (LPG). An embodiment of the invention is one, any or all of prior embodiments in this paragraph up through the first embodiment in this paragraph further comprising passing the $C_{5+}$ hydrocarbon stream to a stabilizer downstream of the catalytic reforming unit. An embodiment of the invention is one, any or all of prior embodiments in this paragraph up through the first embodiment in this paragraph wherein the side cut fraction from the reformate splitter is a benzene rich reformate stream. An embodiment of the invention is one, any or all of prior embodiments in this paragraph up through the first embodiment in this paragraph wherein the concentration of benzene in the benzene lean reformate stream from the benzene saturation unit is less than 0.5%. An embodiment of the invention is one, any or all of prior embodiments in this paragraph up through the first embodiment in this paragraph wherein the concentration of benzene in the benzene lean reformate stream from the benzene saturation unit is less than 0.1%. An embodiment of the invention is one, any or all of prior embodiments in this paragraph up through the first embodiment in this paragraph further comprising passing a portion of the overhead fraction from the reformate splitter to the benzene saturation reactor in the benzene saturation unit. An embodiment of the invention is one, any or all of prior embodiments in this paragraph up through the first embodiment in this paragraph further comprising recovering hydrogen rich gas and liquefied petroleum gas at the overhead of the recontact recovery unit. An embodiment of the invention is one, any or all of prior embodiments in this paragraph up through the first embodiment in this paragraph further comprising saturating aromatics and olefins present in the side cut fraction of the reformate splitter in the benzene saturation unit. An embodiment of the invention is one, any or all of prior embodiments in this paragraph up through the first embodiment in this paragraph wherein the inlet temperature of the benzene saturation reactor ranges from about 120° C. to about 200° C. and the outlet temperature of the benzene saturation reactor ranges from about 150° C. to about 290° C. The operating conditions of the benzene saturation reactor will include an operating pressure in a range from about 1370 kPa to about 3450 kPa. An embodiment of the invention is one, any or all of prior embodiments in this paragraph up through the first embodiment in this paragraph wherein the benzene saturation reactor is configured to receive the hydrogen rich gas stream from the recontact recovery unit. An embodiment of the invention is one, any or all of prior embodiments in this paragraph up through the first embodiment in this paragraph further comprising removing benzene and benzene precursors in a naphtha splitter upstream of the catalytic reforming unit. An embodiment of the invention is one, any or all of prior embodiments in this paragraph up through the first embodiment in this paragraph wherein the benzene precursors are methylcyclopentane (MCP) and cyclohexane (CH).

A second embodiment of the invention is process for removing benzene from a gasoline blending feedstock, the process comprising the steps of: providing the feedstock comprising benzene to a catalytic reforming unit to provide a $C_{5+}$ hydrocarbon stream; passing the $C_{5+}$ hydrocarbon stream to a reformate splitter to provide an overhead fraction and a bottom fraction; passing the overhead fraction to a benzene saturation reactor in a benzene saturation unit to provide a saturated reformate stream; passing saturated reformate stream to a stripper in the benzene saturation unit to provide a benzene lean reformate stream and an off-gas stream; recycling the off-gas stream to a recontact recovery unit to recover hydrogen gas and liquefied petroleum gas. An embodiment of the invention is one, any or all of prior embodiments in this paragraph up through the second embodiment in this paragraph wherein the overhead fraction of the reformate splitter comprises $C_5$ and $C_6$ hydrocarbons. An embodiment of the invention is one, any or all of prior embodiments in this paragraph up through the second embodiment in this paragraph wherein the concentration of benzene in the benzene lean reformate stream from the benzene saturation unit is less than 0.5%. An embodiment of the invention is one, any or all of prior embodiments in this paragraph up through the second embodiment in this paragraph wherein the concentration of benzene in the benzene lean reformate stream from the benzene saturation unit is less than 0.1%. An embodiment of the invention is one, any or all of prior embodiments in this paragraph up through the second embodiment in this paragraph further comprising recovering hydrogen rich gas and liquefied petroleum gas at the overhead of the recontact recovery unit. An embodiment of the invention is one, any or all of prior embodiments in this paragraph up through the second embodiment in this paragraph wherein the inlet temperature of the benzene saturation reactor ranges from about 120° C. to about 200° C. and the outlet temperature of the benzene saturation reactor ranges from about 150° C. to about 290° C. The operating conditions of the benzene saturation reactor will include an operating pressure in a range from about 1370 kPa to about 3450 kPa. An embodiment of the invention is one, any or all of prior embodiments in this paragraph up through the second embodiment in this paragraph further comprising removing benzene and benzene precursors in a naphtha splitter upstream of the catalytic reforming unit.

A third embodiment of the invention is an apparatus for removing benzene from a gasoline blending feedstock comprising: a catalytic reforming unit to convert heavy naphtha to a high octane liquid reformate; a recontact recovery unit downstream of the catalytic reforming unit; a stabilizer downstream of recontact recovery unit; a reformate splitter downstream of the stabilizer; a benzene saturation unit downstream of the reformate splitter; wherein the benzene saturation unit further comprises a benzene saturation reactor and a stripper column; and wherein the stripper column is downstream of the benzene saturation reactor in the benzene saturation unit.

Without further elaboration, it is believed that using the preceding description that one skilled in the art can utilize the present subject matter to its fullest extent and easily ascertain the essential characteristics of this subject matter, without departing from the spirit and scope thereof, to make various changes and modifications of the subject matter and to adapt it to various usages and conditions. The preceding preferred specific embodiments are, therefore, to be construed as merely illustrative, and not limiting the remainder of the disclosure in any way whatsoever, and that it is intended to cover various modifications and equivalent arrangements included within the scope of the appended claims.

The invention claimed is:

1. A process for removing benzene from a gasoline blending feedstock, the process comprising the steps of:

providing the feedstock comprising benzene to a catalytic reforming unit to provide a $C_{5+}$ hydrocarbon stream;

passing the $C_{5+}$ hydrocarbon stream to a reformate splitter to provide an overhead fraction, a side cut fraction and a bottom fraction;

passing the side cut fraction to a benzene saturation reactor in a benzene saturation unit to provide a saturated reformate stream;

passing the saturated reformate stream to a stripper in the benzene saturation unit to provide a benzene lean reformate stream and an off-gas stream; and recycling the off-gas stream to a recontact recovery unit to recover hydrogen gas and liquefied petroleum gas (LPG).

2. The process of claim 1, further comprising passing the $C_{5+}$ hydrocarbon stream to a stabilizer downstream of the catalytic reforming unit.

3. The process of claim 1, wherein the side cut fraction from the reformate splitter is a benzene rich reformate stream.

4. The process of claim 1, wherein the concentration of benzene in the benzene lean reformate stream from the benzene saturation unit is less than 0.5%.

5. The process of claim 4, wherein the concentration of benzene in the benzene lean reformate stream from the benzene saturation unit is less than 0.1%.

6. The process of claim 1, further comprising passing a portion of the overhead fraction from the reformate splitter to the benzene saturation reactor in the benzene saturation unit.

7. The process of claim 1, further comprising recovering hydrogen rich gas and liquefied petroleum gas at the overhead of the recontact recovery unit.

8. The process of claim 1, further comprising saturating aromatics and olefins present in the side cut fraction of the reformate splitter in the benzene saturation unit.

9. The process of claim 1, wherein the inlet temperature of the benzene saturation reactor ranges from about 120° C. to about 200° C. and the outlet temperature of the benzene saturation reactor ranges from about 150° C. to about 290° C. and the pressure of the benzene saturation reactor ranges from about 1370 kPa to about 3450 kPa.

10. The process of claim 1, wherein the benzene saturation reactor is configured to receive the hydrogen rich gas stream from the recontact recovery unit.

11. The process of claim 1, further comprising removing benzene and benzene precursors in a naphtha splitter upstream of the catalytic reforming unit.

12. The process of claim 11, wherein the benzene precursors are methylcyclopentane (MCP) and cyclohexane (CH).

13. A process for removing benzene from a gasoline blending feedstock, the process comprising the steps of:

providing the feedstock comprising benzene to a catalytic reforming unit to provide a $C_{5+}$ hydrocarbon stream;

passing the $C_{5+}$ hydrocarbon stream to a reformate splitter to provide an overhead fraction and a bottom fraction;

passing the overhead fraction to a benzene saturation reactor in a benzene saturation unit to provide a saturated reformate stream;

passing saturated reformate stream to a stripper in the benzene saturation unit to provide a benzene lean reformate stream and an off-gas stream; and recycling the off-gas stream to a recontact recovery unit to recover hydrogen gas and liquefied petroleum gas.

14. The process of claim 13, wherein the overhead fraction of the reformate splitter comprises $C_5$ and $C_6$ hydrocarbons.

15. The process of claim 13, wherein the concentration of benzene in the benzene lean reformate stream from the benzene saturation unit is less than 0.5%.

16. The process of claim 15, wherein the concentration of benzene in the benzene lean reformate stream from the benzene saturation unit is less than 0.1%.

17. The process of claim 13, further comprising recovering hydrogen rich gas and liquefied petroleum gas at the overhead of the recontact recovery unit.

18. The process of claim 13, wherein the inlet temperature of the benzene saturation reactor ranges from about 120° C. to about 200° C. and the outlet temperature of the benzene saturation reactor ranges from about 150° C. to about 290° C. and the pressure of the benzene saturation reactor ranges from about 1370 kPa to about 3450 kPa.

19. The process of claim 13, further comprising removing benzene and benzene precursors in a naphtha splitter upstream of the catalytic reforming unit.

* * * * *